US005138946A

United States Patent [19]

Soltz et al.

[11] Patent Number: 5,138,946

[45] Date of Patent: Aug. 18, 1992

[54] LASER DIODE APPARATUS FOR INITIATION OF EXPLOSIVE DEVICES

[75] Inventors: Barbara A. Soltz, Spring Valley, N.Y.; Charles R. Chubb, St. Peters, Mo.; James D. Cook, Freeport, Ill.; Victor H. Nettle, St. Louis, Mo.; Thomas M. Pallett, III, Florissant, Mo.; Richard G. Podgornik; Dale F. Waldo, both of St. Louis, Mo.

[73] Assignee: McDonnell Douglas Corporation, St. Louis, Mo.

[21] Appl. No.: 719,037

[22] Filed: Jun. 21, 1991

[51] Int. Cl.[5] ..... F42C 19/00

[52] U.S. Cl. ..... 102/201

[58] Field of Search ..... 102/201

[56] References Cited

U.S. PATENT DOCUMENTS

| | | | |
|---|---|---|---|
| 3,362,329 | 1/1968 | Epstein | 102/201 |
| 4,455,941 | 6/1984 | Walker et al. | 102/201 |
| 4,862,802 | 9/1989 | Streifer et al. | 102/201 |
| 4,917,014 | 4/1990 | Loughry et al. | 102/201 |

*Primary Examiner*—Charles T. Jordan

*Attorney, Agent, or Firm*—Benjamin Hudson, Jr.; Timothy H. Courson; Guy R. Gosnell

[57] ABSTRACT

A laser diode apparatus for initiating explosives or other pyrotechnic devices that has capability of checking both the laser diode operation and the optical fiber continuity between the laser diode source and the explosives required to be detonated. Power isolation circuits are provided to control the flow of current to the laser diode, also isolation filters are used to allow only the command signals to initiate the firing circuits employed.

5 Claims, 2 Drawing Sheets

LASER DIODE APPARATUS FOR INITIATION OF EXPLOSIVE DEVICES

BACKGROUND OF THE INVENTION

Field of the Invention

This invention relates generally to laser initiation of explosives and other pyrotechnic devices and more particularly to Laser Diodes for initiating explosive devices that have built-in self check capabilities to check the continuity of the optical circuit and also to provide a safe and arm condition with a device preventing inadvertent ignition of the explosive by the laser. Problems, such as, electrostatic discharges, stray currents, and electrical interference associated with the use of electronic detonators are well documented. As a result, designers have been inclined more and more to utilize laser initiating devices because they have proven to be safer from the hazards associated with electronic detonating devices.

However, even with laser initiating devices, such as the one proposed herein, it would still be desirable if there was a means of checking the continuity of the optical circuit from the laser power source to the explosives. Also, it would be desirable to have a safe and arm feature wherein the laser power source is locked out from initiating a firing sequence prematurely.

SUMMARY OF THE INVENTION

There is provided by this invention a laser diode apparatus for initiating explosives or other pyrotechnic devices that has capability of checking both the laser diode operation and the optical fiber continuity between the laser diode source and the explosives required to be detonated. Power isolation circuits are provided to control the flow of current to the laser diode, also isolation filters are used to allow only the command signals to initiate the firing circuits employed.

DETAILED DESCRIPTION OF THE PREFERRED EMBODIMENT

Figure 1:
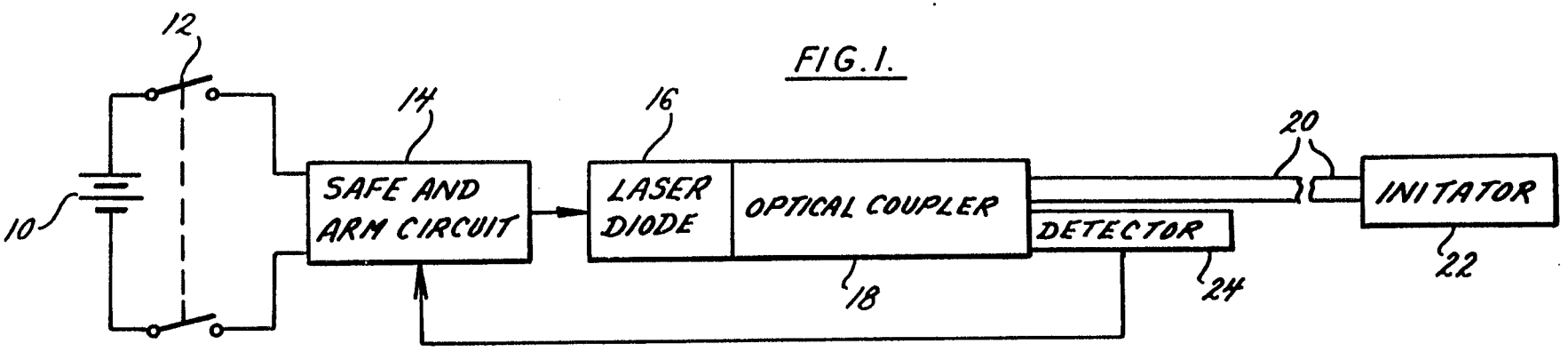
FIG. 1 is a blocked diagram of a laser diode initiating system incorporating the principals of this invention.

Referring to FIG. 1 there is shown a laser diode initiator circuit incorporating the principals of this invention. The circuit is generally comprised of a power supply (10) which supplies power through a switch (12) to a safe and arms circuit (14) which controls the firing of a laser diode (16). The control circuit (14), which will be described hereinafter, generally provides a means for self checking the power source, self checking the laser diode operation, and checking the continuity of the optical circuit to the initiator. The safe and arms circuit initiates the firing of the laser diode (16) through a series of independently operated MOSFETS and isolation filters that allow only the command signal to close the switches, therefore, preventing inadvertent firing of the laser diode (16). The output of the laser diode (16) is coupled by optical devices (18) to an optical fiber (20) that transmit the output of the laser diode to an initiator (22). The optical coupling device (18) may also have means well known to those skilled in the art to receive reflections from the initiator and direct those reflections to a detector (24). This may be accomplished by removing cladding from the fiber 20 so that the detector 24 may receive the back reflections from the initiator 22. The output of the detector (24) is fed back to the safe and arm circuit (14) to provide a monitor of the continuity of the optical circuit. The initiator (22) may be one of several devices well known to those skilled in the art used to detonate explosives or the like in response to the optical energy supplied by the laser diode (16). The initiator may have an explosive mix of Zr-$KClO_4$.

Figure 2:
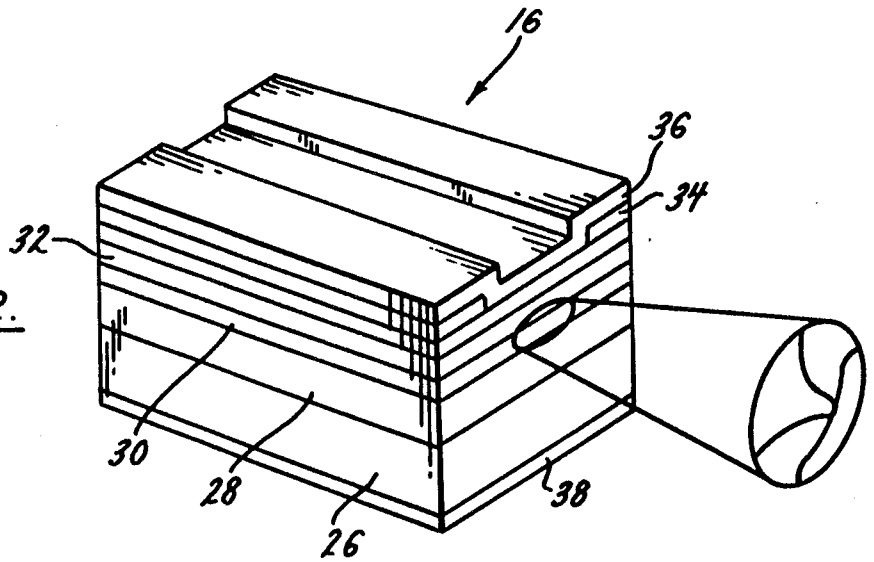
FIG. 2 is a perspective view of a laser diode utilized in the initiating system shown in FIG. 1.

As shown in FIG. 2 the laser diode (16) is a typical laser type semiconductor having an N-substrate (26), an N-cladding layer (28), an active layer (30), a P-cladding layer (32), an oxide cap layer (34) and metallic contacts (36) and (38). The laser diode is initially operated at low power spontaneous emission levels for the light therefrom to illuminate the initiator but the power is low enough to avoid ignition. The reflected light from the initiator is detected by the detector to indicate whether or not there is continuity in the optical circuit.

Figure 3:
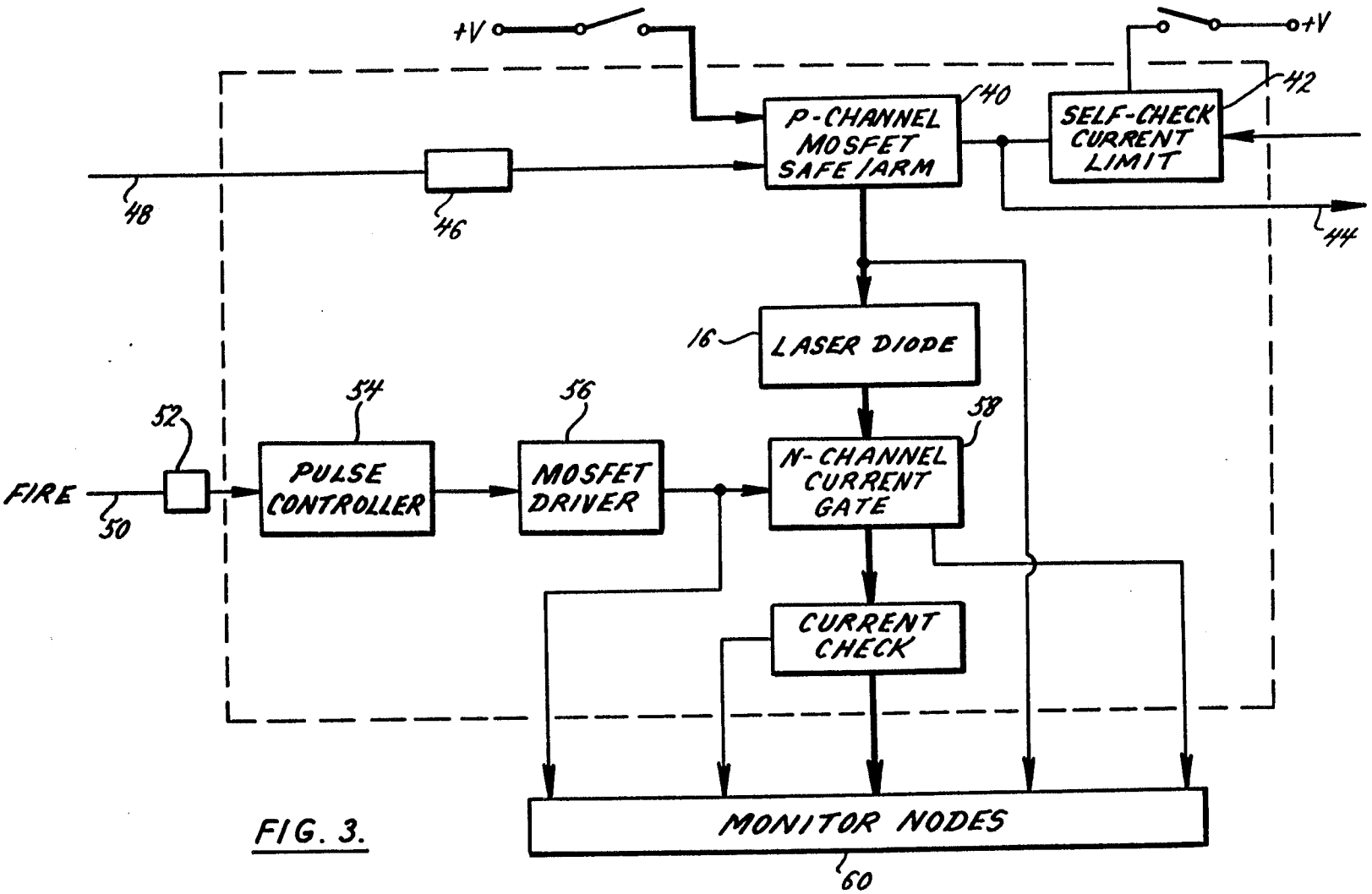
FIG. 3 is a blocked diagram of the electronic safe and arms system utilized in FIG. 1.

Referring to FIG. 3, the electronic safe and arm circuit is shown incorporating the principles of this invention. A MOSFET safe and arm switch 40 controls the application of a firing voltage to the laser diode 16. A self-check current limit switch 42 continuously monitors the ready status of the safe and arm switch 40 via node 44. Control signals to the switch 40 are filtered by isolation filters 46. Signals along the control line 48 serve as prearm or arming commands. The fire command signal 50 is passed through an isolation filter 52 and is processed first by a pulse controller 54 and amplified by a MOSFET driver 56 which activates a current gate 58. Activation of the current gate 58 excites the laser to fire at full power for initiation. Monitor nodes such as shown at 60 provide means to monitor the status of the functions described above.

We claim:

1. Apparatus for laser ignition of explosives, comprising:

a) light means for producing optical energy;

b) optical coupler means for connecting the optical energy to an optical fiber for transmission therethrough;

c) ignition means connected to the optical fiber for receiving the optical energy wherein the ignition means is disposed to ignite an explosive charge at a predetermined optical energy level;

d) electrical control means connected to the light means for generating optical energy at a low threshold power level wherein optical energy is reflected from the ignition means into the optical fiber;

e) detector means connecting to the optical coupler means for receiving the reflected optical energy wherein the detector means supplies an input to the electrical control means indicating the status of continuity in the optical circuit; and f) the electrical control means further comprising firing circuits wherein command signals are first passed through isolation filters for generating a high threshold power level to ignite the ignition means.

2. Apparatus for laser ignition of explosives as recited in claim 1 wherein the electrical control means comprises circuits to prearm the light means to a ready state before igniting the ignition means.

3. Apparatus for laser ignition of explosives as recited in claim 2 wherein the electrical control means comprises circuits to energize the light means for firing after the prearm ready state to ignite the ignition means.

4. Apparatus for laser ignition of explosives as recited in claim 3 wherein the electrical control means comprises circuits to monitor the prearm ready state and the firing state of the light means.

5. Apparatus for laser ignition of explosives as recited in claim 3 wherein the light means is comprised of a laser diode.

* * * * *